US007837435B2

(12) United States Patent
Ellis et al.

(10) Patent No.: US 7,837,435 B2
(45) Date of Patent: Nov. 23, 2010

(54) STATOR DAMPER SHIM

(75) Inventors: Charles Ellis, Stuart, FL (US); Terry Hollis, Wellington, FL (US); David Medrano, Okeechobee, FL (US)

(73) Assignee: Power System Mfg., LLC, Jupiter, FL (US)

( * ) Notice: Subject to any disclaimer, the term of this patent is extended or adjusted under 35 U.S.C. 154(b) by 872 days.

(21) Appl. No.: 11/744,245

(22) Filed: May 4, 2007

(65) Prior Publication Data

US 2008/0273964 A1 Nov. 6, 2008

(51) Int. Cl.
*F01D 25/04* (2006.01)

(52) U.S. Cl. ..... 415/119; 415/189

(58) Field of Classification Search ..... 415/119, 415/185, 189, 190, 191, 209.1, 209.4
See application file for complete search history.

(56) References Cited

U.S. PATENT DOCUMENTS 1,772,414 A * 8/1930 Brooke-Hunt et al. ..... 267/293
4,314,792 A 2/1982 Chaplin
4,897,021 A 1/1990 Chaplin et al.
5,215,432 A 6/1993 Pickering et al.
5,407,321 A 4/1995 Rimkunas et al.
5,681,142 A 10/1997 Lewis
6,050,776 A * 4/2000 Akagi et al. ..... 415/209.4
6,592,326 B2 * 7/2003 Marx et al. ..... 415/208.2
6,969,239 B2 11/2005 Grant et al.
7,101,150 B2 * 9/2006 Bash et al. ..... 415/191

* cited by examiner

*Primary Examiner*—Edward Look
*Assistant Examiner*—Ryan H Ellis
(74) *Attorney, Agent, or Firm*—Shook Hardy Bacon LLP

(57) ABSTRACT

A system and method for reducing vibration and wear to adjacent platform surfaces and mounting locations of a vane segment in a gas turbine engine is disclosed. The present invention seeks to improve the interaction between mating faces of adjacent gas turbine vane assemblies by increasing the surface area where contact between the adjacent vanes occurs, so as to increase the damping capability and reduce the wear to the mating surfaces.

15 Claims, 5 Drawing Sheets

STATOR DAMPER SHIM

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates generally to gas turbine engines and more specifically to a vane configuration having reduced wear along mating surfaces.

BACKGROUND OF THE INVENTION

A gas turbine engine typically comprises a multi-stage compressor that compresses air, which has been drawn into the engine, to a higher pressure and temperature. A majority of this air passes to the combustion system, which mixes the compressed and heated air with fuel and contains the resulting reaction that generates the hot combustion gases. These gases then pass through a multi-stage turbine, which, in turn drives the compressor, and possibly a shaft of an electrical generator. Exhaust from the turbine can also be channeled to provide thrust for propulsion of a vehicle.

Typical compressors and turbines comprise a plurality of alternating rows of rotating and stationary airfoils. An example of a vane segment, or stator section, comprising a plurality of airfoils positioned between an inner platform and outer platform is shown in FIG. 1. In this embodiment of the prior art, the vane segment spans approximately 180 degrees where two vane segments together encompass an engine shaft (not shown) which runs along the engine centerline. A vane segment 10 of the prior art, is shown in FIG. 1, and comprises an inner platform 12, an outer platform 14, and vanes 16 extending between inner platform 12 and outer platform 14. The vane segment 10 encompasses approximately 180 degree span and is in accordance with typical vane styles of the prior art.

The stationary airfoils, or vanes, direct the flow of air in a compressor or hot combustion gases in a turbine onto a subsequent row of rotating airfoils, or blades, at the proper orientation in order to maximize the output of the compressor or turbine. To minimize manufacturing costs as well as to improve response to thermal gradients and thermal deflections, more recent engine designs utilize a plurality of vane assemblies in the compressor or turbine. These vane assemblies include at least one airfoil bounded on either end by a section of an outer platform and an inner platform, with the inner platform located closer to the engine centerline. Each of the vane assemblies typically span a few degrees and have a shorter arc length than the prior art half-ring segments. Depending on how the vane assemblies are mounted in the engine, significant movement can occur between adjacent vane assemblies causing undesirable contact and wear. When vane assemblies are mounted at or near their outer platform, thereby causing them to essentially hang free at the inner platform, relatively large movement can occur at the inner platform due to the distance of the inner platform from the mounting location, vibrations, and differences in thermal gradients between the adjacent vane assemblies. When such motion occurs between adjacent vane assemblies, significant wear can occur along the mating surfaces due to the mating surfaces essentially damping the vibrations. Significant wear is also found at the hooks that hold the vane assemblies in place due to the amount of movement at the inner platform and the surface-to-surface contact at the mounting location. This excessive wear can lead to premature repair or require replacement of the vane assemblies.

What is needed is a vane assembly configuration that reduces the amount of wear that occurs along mating faces of adjacent vane assemblies and at the mounting location so as to increase the life of the vane assemblies.

SUMMARY OF THE INVENTION

The present invention is defined by the claims below. Embodiments of the present invention solve at least the above problems by providing a system and method for, among other things, reducing vibration and wear along adjacent platform surfaces and mounting locations of a plurality of vane assemblies in a gas turbine engine.

The present invention seeks to improve the interaction between mating faces of adjacent gas turbine vanes by increasing the surface area where contact between the adjacent vanes occurs. In a first embodiment of the present invention, a gas turbine engine having a plurality of vane assemblies extending about an engine centerline having inner and outer arc-shaped platforms with at least one airfoil extending therebetween are disclosed. First and second extension plates extend radially inward from the inner platform and have a plurality of first openings, and are fixed to first and second side faces of the inner arc-shaped platform. Positioned between the extension plates, and having a plurality of second openings, is at least one shim plate. At least one fastener is positioned so as to secure the extension plates and shim plate together in a removable manner, thereby increasing the surface area along which adjacent vane assemblies interact.

In an alternate embodiment of the invention, a shim plate assembly for use in a gas turbine engine is disclosed. The shim plate assembly comprises first and second extension plates having a first plurality of openings and at least one shim plate positioned therebetween, with the shim plate having a second plurality of openings. The axial length of the shim plate is greater than the length of the extension plates. A locating pin is positioned proximate the mid-span of the shim plate and extension plates so as to properly position the plates relative to one another while at least one fastener is positioned through the first and second plurality of openings in the plates so as to fix the extension plates and at least one shim plate together.

In yet another alternate embodiment, a method of reducing wear along mating surfaces of a vane segment is disclosed. A slot is cut through a vane segment inner arc-shaped platform from the surface opposite of the airfoils and circumferentially between adjacent airfoils. A block, pre-machined to include a first plurality of openings, is fixed in the slot. The vane segment is then cut, between adjacent airfoils, through the inner and outer arc-shaped platforms, including the machined block. As a result, a plurality of vane assemblies are formed, with each vane assembly having an extension plate fixed to each side face of the vane assembly inner platform. A locating pin is then placed in one of the first plurality of openings and at least one shim plate is inserted between the extension plates. The extension plates are then fixed to the at least one shim plate by passing at least one fastener through the remaining openings in the extension plates and corresponding openings in the shim plate.

In accordance with these and other objects, which will become apparent hereinafter, the instant invention will now be described with particular reference to the accompanying drawings. Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The present invention is shown in detail in FIGS. 2-6 and is applicable to both individual vane assemblies as well as half-ring vane segments. While the present invention is directed primarily towards vane assemblies or vane segments for a compressor, other vane locations, such as in the engine inlet or the turbine section could also utilize such a design if desired.

Figure 1:
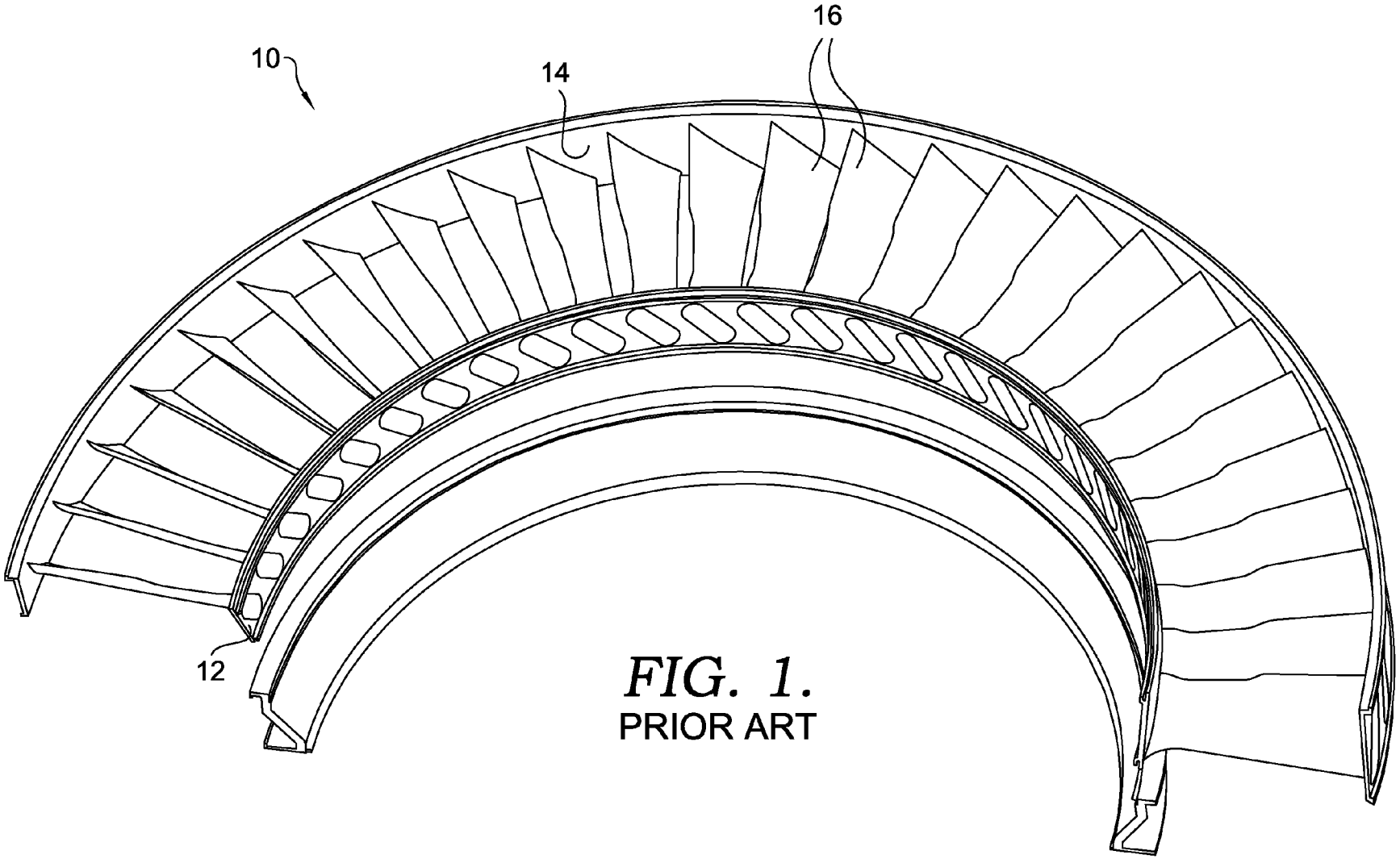
FIG. 1. PRIOR ART
FIG. 1 is a perspective view of a vane segment of the prior art.
Figure 2:
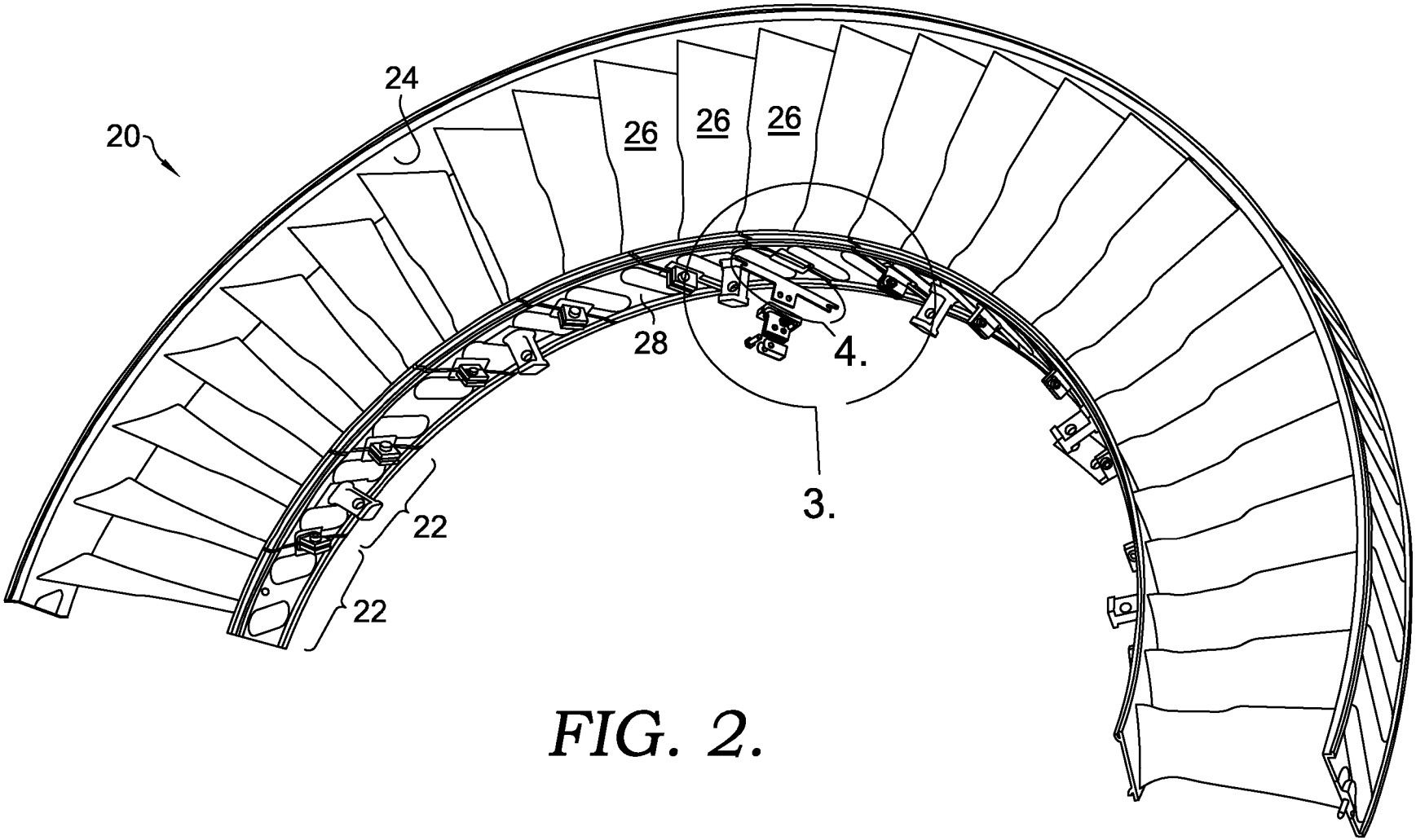
FIG. 2 is a perspective view of a vane segment in accordance with an embodiment of the present invention.
Figure 3:
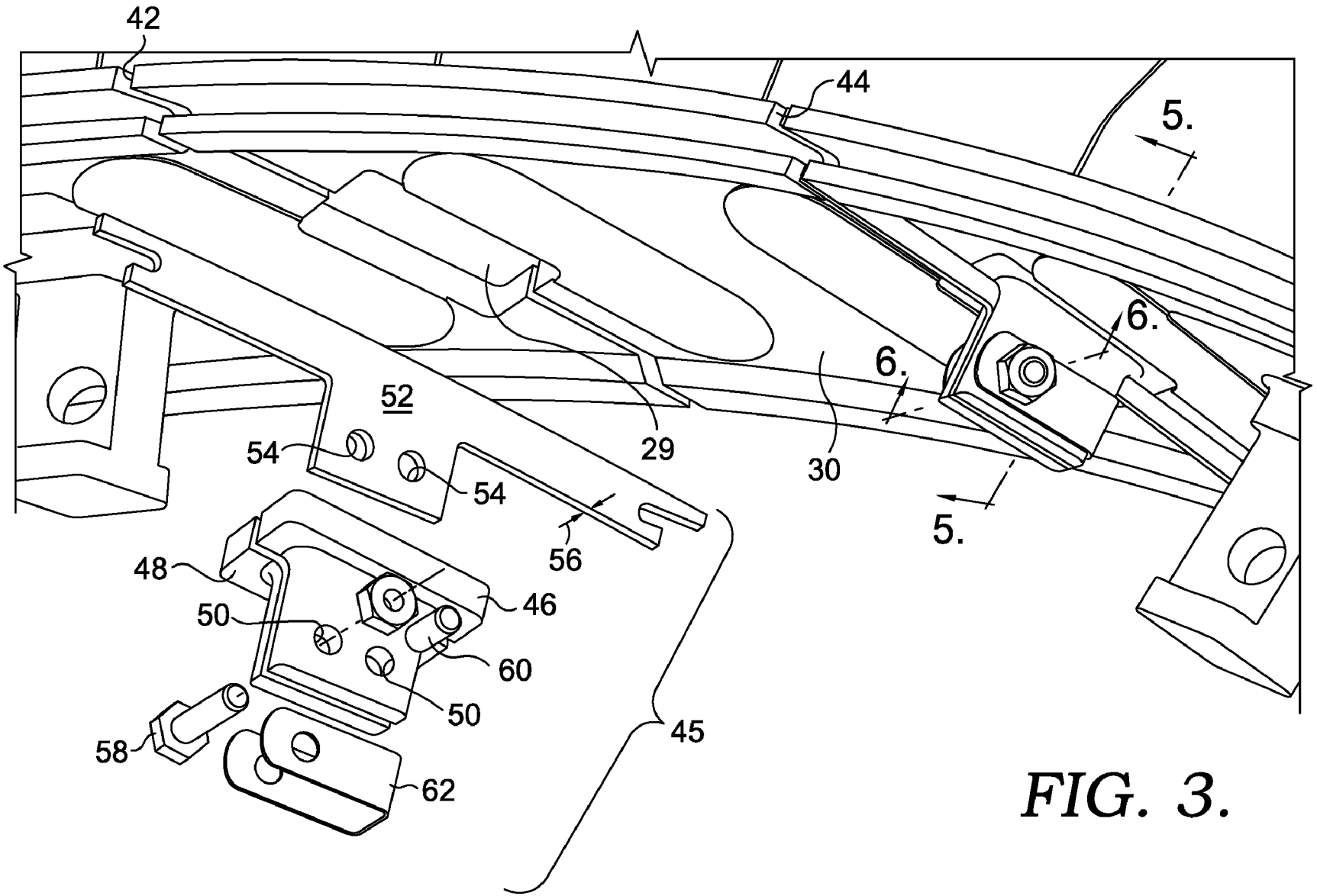
FIG. 3 is an exploded view of shim plate assembly for use with a vane assembly in accordance with an embodiment of the present invention.
Figure 4:
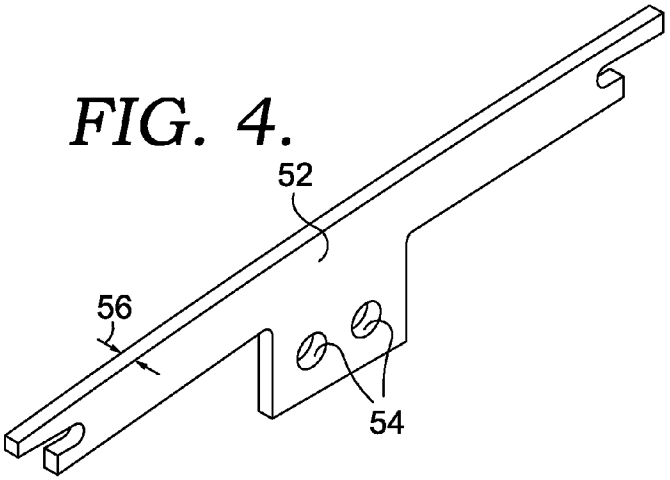
FIG. 4 is a perspective view of a shim plate in accordance with an embodiment of the present invention.
Figure 5:
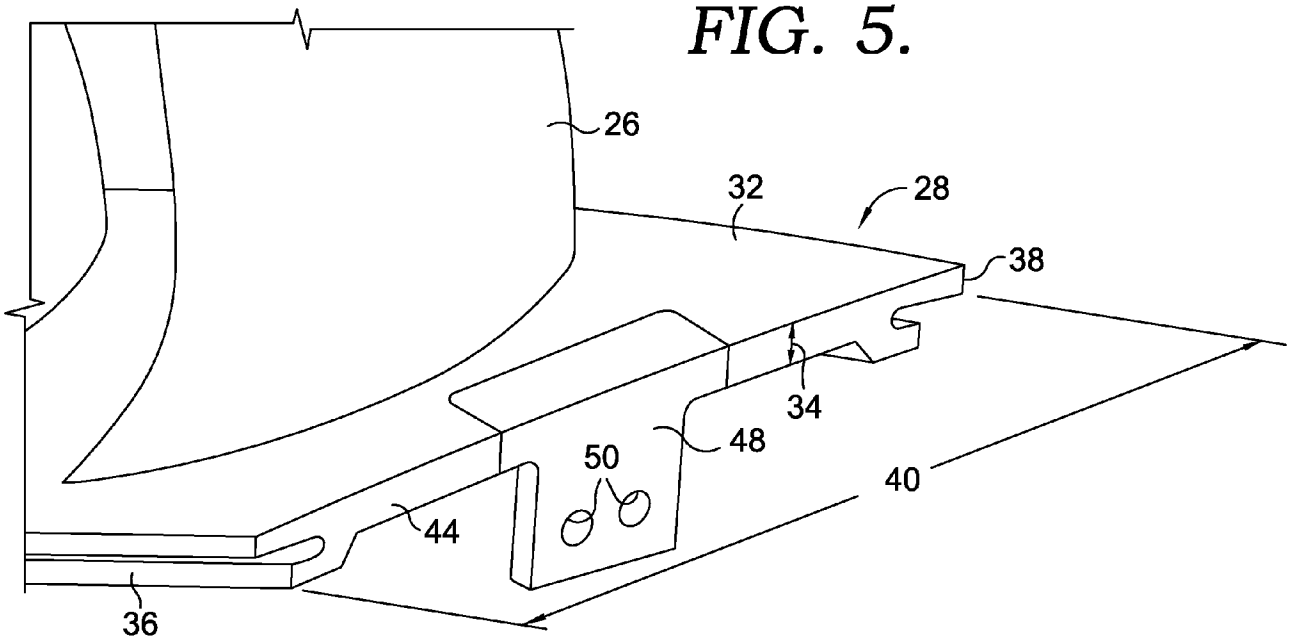
FIG. 5 is a partial perspective view of the inner platform of a vane assembly in accordance with an embodiment of the present invention.
Figure 6:
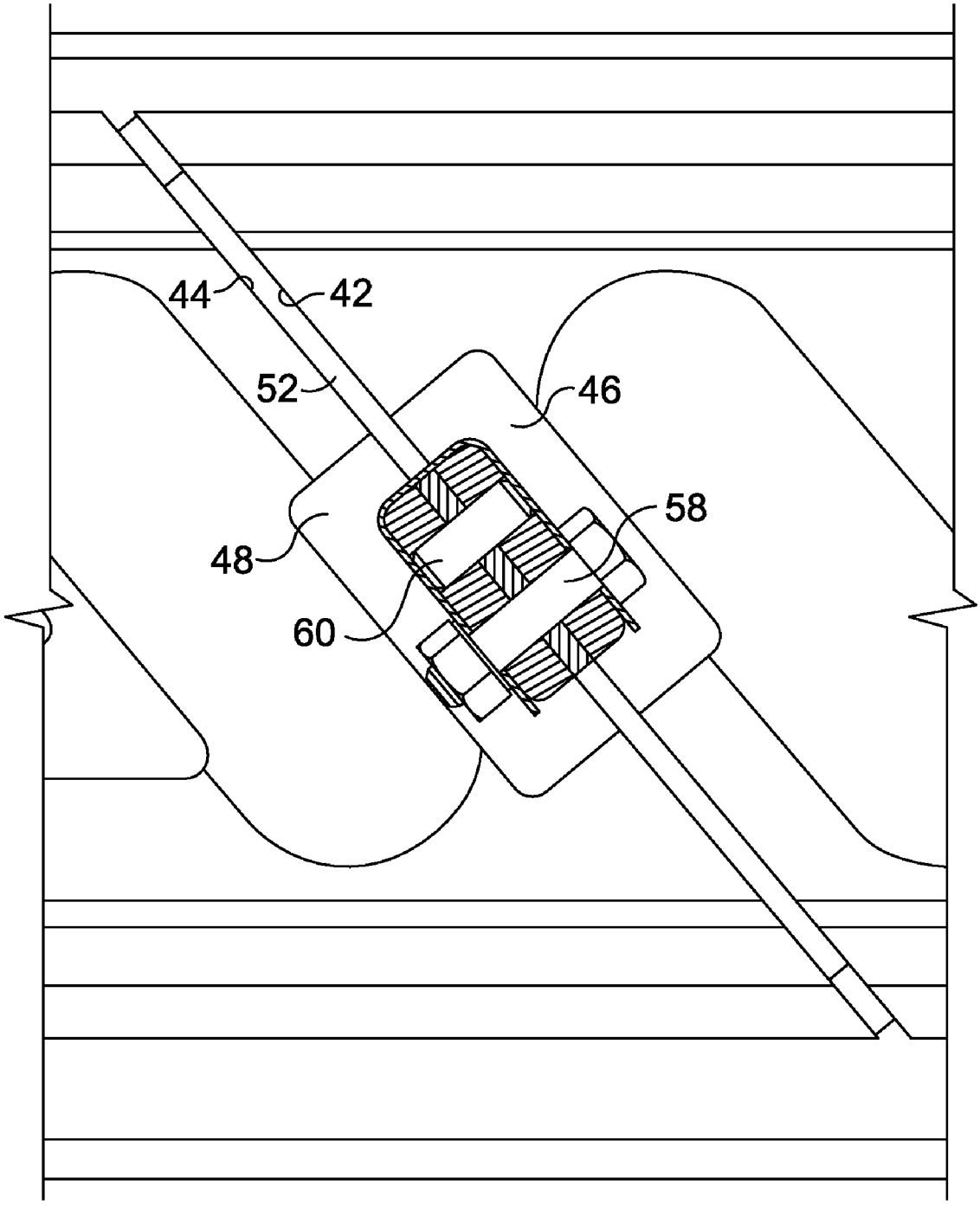
FIG. 6 is a cross section view of a shim plate assembly in a vane assembly in accordance with an embodiment of the present invention.

Referring initially to FIG. 2, an embodiment of the present invention comprises a vane segment 20 that extends circumferentially about an engine centerline and having a plurality of vane assemblies 22. As previously discussed, the vane segments or assemblies that are supported from the outer platform are those that exhibit the greatest wear indications along the outer platform. The vane assemblies 22 comprise an outer arc-shaped platform 24, at least one airfoil 26 extending radially inward from the outer-arc-shaped platform 24. Fixed to the at least one airfoil 26, opposite the outer arc-shaped platform 24, is an inner arc-shaped platform 28. Referring to FIGS. 3 and 5, the inner arc-shaped platform 28 comprises a first surface 30 and a second surface 32 located radially outward of the first surface 30, to thereby form a platform thickness 34. The inner arc-shaped platform 28 also comprises a forward face 36 and an aft face 38 spaced an axial distance from the forward face, thereby forming a platform length 40. Referring now to FIGS. 3, 5, and 6, the inner arc-shaped platform 28 also comprises a first side face 42 and a second side face 44, with the sidefaces being generally parallel.

As previously discussed, the present invention reduces wear on the mating platform surfaces by increasing the surface area at which contact occurs, so as to provide more damping. This is accomplished for a plurality of vane assemblies through a shim plate assembly 45. A first extension plate 46 is fixed to the first side face 42, while a second extension plate 48 is fixed to the second side face 44. The extension plates 46 and 48 have a first axial length and are preferably fixed to the inner arc-shaped platform 28 by electron beam (EB) welding. Such a process ensures a clean and complete weld through the thickness of the platform and the extension plate. In order to have the best weld properties, it is preferred that the extension plate is fabricated from a material having similar properties as the vane assemblies. The extension plates 46 and 48 extend radially inward from the inner arc-shaped platform 28 and have a first plurality of openings 50 comprising at least two openings. The present invention also comprises at least one shim plate 52 that has a second axial length and second plurality of opening 54 with a plate thickness 56 and at least one fastener 58. As it can be seen from FIG. 3, the second axial length is greater than the first axial length of the extension plates 46 and 48.

The at least one shim plate 52, which is also fabricated from a material similar to the extension plates and the vane assembly, is positioned between the first and second extension plates, 46 and 48, of adjacent vane assemblies. That is, with each vane assembly having a first side face 42 and a second side face 44, the first and second side faces would normally contact one another, and therefore, the first and second extension plates, 46 and 48, of adjacent vane assemblies provide increased areas for contact. The shim plate 52 is positioned such that the second plurality of openings 54, which also comprises at least two openings, correspond to the first plurality of openings 50 and the at least one fastener 58 is positioned at least partially through the first and second openings, 50 and 54, so as to fix the adjacent vane assemblies together. The shim plate 52, as it can be seen from FIG. 6, extends substantially along the platform length 40. This assembly arrangement is shown in cross section in FIG. 6. The at least one fastener 58 is removable to allow for disassembly of the vane assemblies for routine maintenance and overhaul. The shim plate 52 further comprises a wear reduction coating that is applied to at least the surfaces of the shim plate 52 that contact the first and second extension plates 46 and 48. This coating is preferably an Aluminum Bronze and is applied in order to ensure that damping action of the shim plate will not diminish over time.

Located through one of the at least two openings in extension plates 46 and 48 and through the shim plate 52 is a locating pin 60. The locating pin 60 helps to position adjacent vane assemblies in the proper orientation while fasteners 58 are installed through the first and second plurality of openings 50 and 54 in the extension plates and the shim plate. The locating pin 60 is intended to be contained within the shim plate assembly 45 and not to become dislodged during engine operation. This can be accomplished by tack welding the locating pin 60 to one of the extension plates 46 or 48. Alternatively, the locating pin 60 can be contained by a retaining plate 62, through which at least one fastener 58 passes.

In one embodiment of the present invention, an apparatus is disclosed for reducing wear caused by vibration along mating surfaces of adjacent turbine vane assemblies 22. In another embodiment, a method of reducing wear along mating surfaces of a vane segment is provided. In this method, an existing vane segment 10, similar to a half-ring segment of the prior art, is modified to incorporate one or more shim plate assemblies 45 to reduce wear on the inner platforms and along the mounting locations at the outer platform. The method comprises providing a vane segment 10 having an outer arc-shaped platform 14, a plurality of airfoils 16 extending radially inward from the outer arc-shaped platform 14, and an inner arc-shaped platform 12 fixed to the plurality of airfoils 16 opposite the outer arc-shaped platform 14.

Referring to FIG. 3, a cut is made through a surface of the inner arc-shaped platform that is opposite the plurality of airfoils, to form a slot 29. That is, the slot 29 is cut from the radially inner-most surface outward towards the airfoils. Also, the slot is cut between adjacent airfoils. Next, a machined block is fixed in the slot 29. The block is preferably fabricated from a material similar in properties to the vane segment and is machined to have a first plurality of openings 50. The block is permanently fixed in the slot 29, preferably by electron beam welding. However, alternate means to fix the block in the slot 29 are acceptable as long as a complete joint is achieved.

Once the block is fixed in the slot 29, the vane segment is cut between the adjacent airfoils, through both the inner and outer arc-shaped platforms and the machined block. The cutting of the vane segment 10 forms a plurality of vane assemblies 22 with the machined block split into two parts, thereby forming two extension plates 46 and 48, with each extension plate remaining fixed to the inner arc-shaped platform 28.

As a result of cutting the vane segment into individual assemblies 22, the natural tendency of an assembly 22 is to spring back to a more relaxed position and not maintain as much of the arc shape in the platforms. In order to help the vane assemblies 22 maintain their shape and to assist in properly re-aligning the vane assemblies 22 into a segment 20, a locating pin 60 is placed in one of the first plurality of openings 50. The locating pin 60 can be placed in any of the first openings 50. However, if the first plurality of openings 50 comprises three openings, then it is preferred that the locating pin 60 be placed in the opening closest to the center of the extension plates 46 and 48. Next, at least one shim plate 52 having a second plurality of openings 54 is inserted between the extension plates 46 and 48. Depending on the vane assembly configuration and expected wear, the at least one shim plate 52 may also include a wear reduction coating, such as an Aluminum Bronze coating, applied to surfaces of the shim plate 52 that mate with the extension plates. The shim plate(s) 52 has a thickness that corresponds to the thickness of material lost when the vane segment was cut into individual assemblies 22. Depending on the amount of material lost during the cutting process, more than one shim plate 52 may be required. The extension plates 46 and 48 and at least one shim plate 52 are fixed together by passing at least one fastener 58 through the remaining plurality of first and second openings 50 and 54.

From the foregoing, it will be seen that this invention is one well adapted to attain all the ends and objects set forth above, together with other advantages which are obvious and inherent to the system and method. While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A gas turbine engine having a plurality of vane assemblies extending circumferentially about an engine centerline, the vane assemblies comprising:

an outer arc-shaped platform;

at least one airfoil extending radially inward from the outer arc-shaped platform;

an inner arc-shaped platform fixed to the at least one airfoil opposite the outer arc-shaped platform, the inner arc-shaped platform comprising:

a first surface;

a second surface located radially outward of the first surface, thereby forming a platform thickness therebetween;

a forward face;

an aft face spaced an axial distance from the forward face, thereby forming a platform length;

a first side face and a second side face, the first and second side faces being generally parallel;

a first extension plate fixed to the first side face and a second extension plate fixed to the second side face, the extension plates extending radially inward from the inner arc-shaped platform, the extension plates having a first plurality of openings;

at least one shim plate having a second plurality of openings and a plate thickness; and at least one fastener;

wherein the at least one shim plate is positioned between the first and second extension plates of adjacent vane assemblies, such that the second plurality of openings corresponds to the first plurality of openings and the at least one fastener is positioned at least partially through the first and second openings so as to fix the adjacent vane assemblies together.

2. The gas turbine engine of claim 1 wherein the plurality of vane assemblies are positioned in a compressor section of the engine.

3. The gas turbine engine of claim 2 wherein the vane assemblies are supported in the compressor from the outer arc-shaped platform.

4. The gas turbine engine of claim 1 wherein the extension plates and at least one shim plate are fabricated from a material having similar properties as the vane assemblies.

5. The gas turbine engine of claim 1 wherein the first and second plurality of openings comprises at least two openings.

6. The gas turbine engine of claim 5 wherein a locating pin is placed through one of the at least two openings in the extension plates and the at least one shim plate.

7. The gas turbine engine of claim 1 wherein the at least one shim plate further comprises a wear reduction coating applied to at least surfaces of the shim plate that contact the first and second extension plates.

8. The gas turbine engine of claim 1 wherein the at least one fastener is removable from the first and second extension plates and the at least one shim plate.

9. A shim plate assembly for use in a gas turbine engine comprising:

a first extension plate having a first plurality of openings and a first axial length;

a second extension plate having a first plurality of openings and a first axial length;

at least one shim plate positioned between the first and second extension plates, the at least one shim plate having a second axial length and a second plurality of openings, the second axial length being greater than the first axial length of the first and second extension plates;

a locating pin positioned proximate a mid-span of the at least one shim plate and the extension plates and through one of the first and second openings; and at least one fastener positioned through the first and second plurality of openings in the extension plates and the shim plate.

10. The shim plate assembly of claim 9 wherein the at least one fastener is removable.

11. The shim plate assembly of claim 9 wherein the first and second plurality of openings comprises at least two openings.

12. The shim plate assembly of claim 11 wherein the first and second openings are substantially similar in diameter.

13. The shim plate assembly of claim 12 wherein the locating pin is placed in the first and second opening located closest to a center of the shim plate assembly.

14. The shim plate assembly of claim 9 wherein the first extension plate is fixed to a first side face of a vane assembly and the second extension plate is fixed to a second side face of an adjacent vane assembly such that the extension plates and shim plate approximately doubles surface contact area between the adjacent vane assemblies.

15. The shim plate assembly of claim 9 wherein the shim plate further comprises a wear reduction coating applied to at least surfaces of the shim plate that contact the first and second extension plates.

* * * * *